US008215248B2

(12) United States Patent
Kilgore

(10) Patent No.: US 8,215,248 B2
(45) Date of Patent: Jul. 10, 2012

(54) DOUBLE ACTING CYLINDER FOR TUFTING MACHINE GATE APPARATUS

(75) Inventor: Michael L. Kilgore, Whitwell, TN (US)

(73) Assignee: Tuftco Corporation, Chattanooga, TN (US)

( * ) Notice: Subject to any disclaimer, the term of this patent is extended or adjusted under 35 U.S.C. 154(b) by 476 days.

(21) Appl. No.: 12/432,554

(22) Filed: Apr. 29, 2009

(65) Prior Publication Data

US 2009/0266280 A1 Oct. 29, 2009

Related U.S. Application Data

(60) Provisional application No. 61/048,743, filed on Apr. 29, 2008.

(51) Int. Cl.
*D05C 15/00* (2006.01)

(52) U.S. Cl. ..... 112/80.51

(58) Field of Classification Search ..... 112/80.51, 112/80.55, 80.56, 80.5, 80.52, 80.6; 74/10 R, 74/10.27, 10.37, 10.39
See application file for complete search history.

(56) References Cited

U.S. PATENT DOCUMENTS

| | | | | | |
|---|---|---|---|---|---|
| 2,260,599 | A * | 10/1941 | Benton et al. | ..... | 74/10.33 |
| 4,134,347 | A * | 1/1979 | Jolley et al. | ..... | 112/80.51 |
| 4,194,403 | A * | 3/1980 | Santoro | ..... | 74/10.33 |
| 4,353,317 | A * | 10/1982 | Crumbliss | ..... | 112/80.51 |
| 4,466,366 | A * | 8/1984 | Hirotsu | ..... | 112/80.56 |
| 6,155,187 | A * | 12/2000 | Bennett et al. | ..... | 112/80.51 |
| 7,007,617 | B2 * | 3/2006 | Johnston | ..... | 112/80.51 |
| 7,222,576 | B2 * | 5/2007 | Kilgore | ..... | 112/80.5 |
| 7,814,850 | B2 * | 10/2010 | Bearden | ..... | 112/80.4 |

* cited by examiner

*Primary Examiner* — Tejash Patel
(74) *Attorney, Agent, or Firm* — Miller & Martin PLLC

(57) ABSTRACT

A gated looper apparatus has an array of individually mounted pressurizable air cylinders with piston rods acting in communication with looper gates. The air cylinders are designed to be responsive to pneumatic pressure to extend and retract the associated piston rods.

20 Claims, 4 Drawing Sheets

DOUBLE ACTING CYLINDER FOR TUFTING MACHINE GATE APPARATUS

The present application claims priority to the Apr. 29, 2008 filing date of U.S. provisional patent application, Ser. No. 61/048,743.

FIELD OF THE INVENTION

The present invention relates to the manufacture of tufted fabrics, and particularly to a double acting gate apparatus to allow a looper to tuft either loop pile or cut pile stitches.

BACKGROUND OF THE INVENTION

In the field of tufting, there have been a variety of efforts made to enable both cut pile and loop pile tufts or bights of yarn to be placed in the same row of stitches. In some instances, the structures utilized for this purpose did not allow effective control of the height of stitches and, for instance, the cut pile stitches might always be of greater height than the loop pile stitches. The use of pivoting gate structures on the loopers was proposed in Jolley, U.S. Pat. No. 4,134,347 and Crumbliss, U.S. Pat. No. 4,353,317.

Later sliding gate structures were proposed as typified by Bennett, U.S. Pat. No. 6,155,187. When properly implemented, sliding gate structures may provide rapid response and avoid moving the entire pneumatic activation assembly with the loopers. However, Bennett taught the use of internal biasing elements in pneumatic cylinders and the use of blocks of cylinders to improve efficiencies in assembly. In practice, the use of internal biasing elements limits the size and corresponding force that the biasing elements may provide. In turn, this limits the speed with which the gate can return to the open position after pressure to its corresponding pneumatic cylinder is stopped. Furthermore, the internal biasing elements are not visible to inspection and if rust begins to form due to moisture in the cylinder, for instance, there will be no way to detect the problem until performance degrades to the point where defective carpet patterns are produced, with resulting waste carpet and the need to replace an entire cylinder block rather than merely a spring or biasing element.

A sliding gate structure utilizing an external spring was proposed in Kilgore, U.S. Pat. No. 7,222,576. Other efforts to improve the operation of gated loopers have focused on the gate assembly itself as in Johnston, U.S. Publication No. 2005/0109253.

The spring return gates suffer from a number of shortcomings, regardless of whether the spring is internally or externally placed. Principal among these shortcomings are the durability of the springs and the fact that a spring's biasing force changes over the range of compression of the spring. Thus, the durability of springs manifests itself over time as the spring material fatigues and the biasing force provided by the springs to slide the gate structures to the return position is diminished. Eventually, springs will even break from mechanical fatigue.

In addition, the further a spring is compressed, the greater the biasing force of the spring acting against the compression. Thus, if the spring is oriented to return the gate to retracted position, the spring is nearly fully compressed when the gate reaches its extended position. As the gate approaches the fully extended position, the spring is more fully compressed and the biasing force acting against the air pressure of a pneumatic cylinder increases. Due to friction between moving parts and the increased biasing force acting against the pneumatic pressure, some gates stick or fail to reach a fully extended position. Similarly, the further a spring is decompressed, the less biasing force the spring possesses. As the spring force gets weaker, it may fail to force all of the air in the cylinder to exhaust, causing the gate to stick before returning the gate to the fully retracted position.

It is desirable to address these shortcomings of spring biased gate structures without significantly increasing the cost or complexity of the gate control mechanisms.

SUMMARY OF THE INVENTION

Therefore, it is a primary object of the invention to provide an improved sliding gate structure for use in tufting both loop pile and cut pile stitches from yarns seized by the same looper.

It is another object of the invention to provide a double acting, or two way, pneumatically activated sliding gate structure to move the gates from their open and unactivated position to their closed and activated positions and back again.

It is yet another object of the invention to provide a double acting pneumatic drive mechanism for a sliding gate structure that tends to return the gates to their open and inactivated position.

It is further object of the invention to provide an array of pneumatic cylinders and corresponding activated sliding gates in a compact form so as to be effectively employed with narrow gauge needle configurations according to the present invention.

It is a still further object of the invention to provide an array of double acting pneumatic cylinders in a cost effective structure that does not add unnecessary complexity to the sliding gate mechanism and controls.

BRIEF DESCRIPTION OF THE DRAWINGS

The particular features and objects of the invention as well as other advantages will be appreciated from the following description in connection with the drawings of an embodiment of the invention in which.

DETAILED DESCRIPTION OF THE INVENTION

Figure 1:
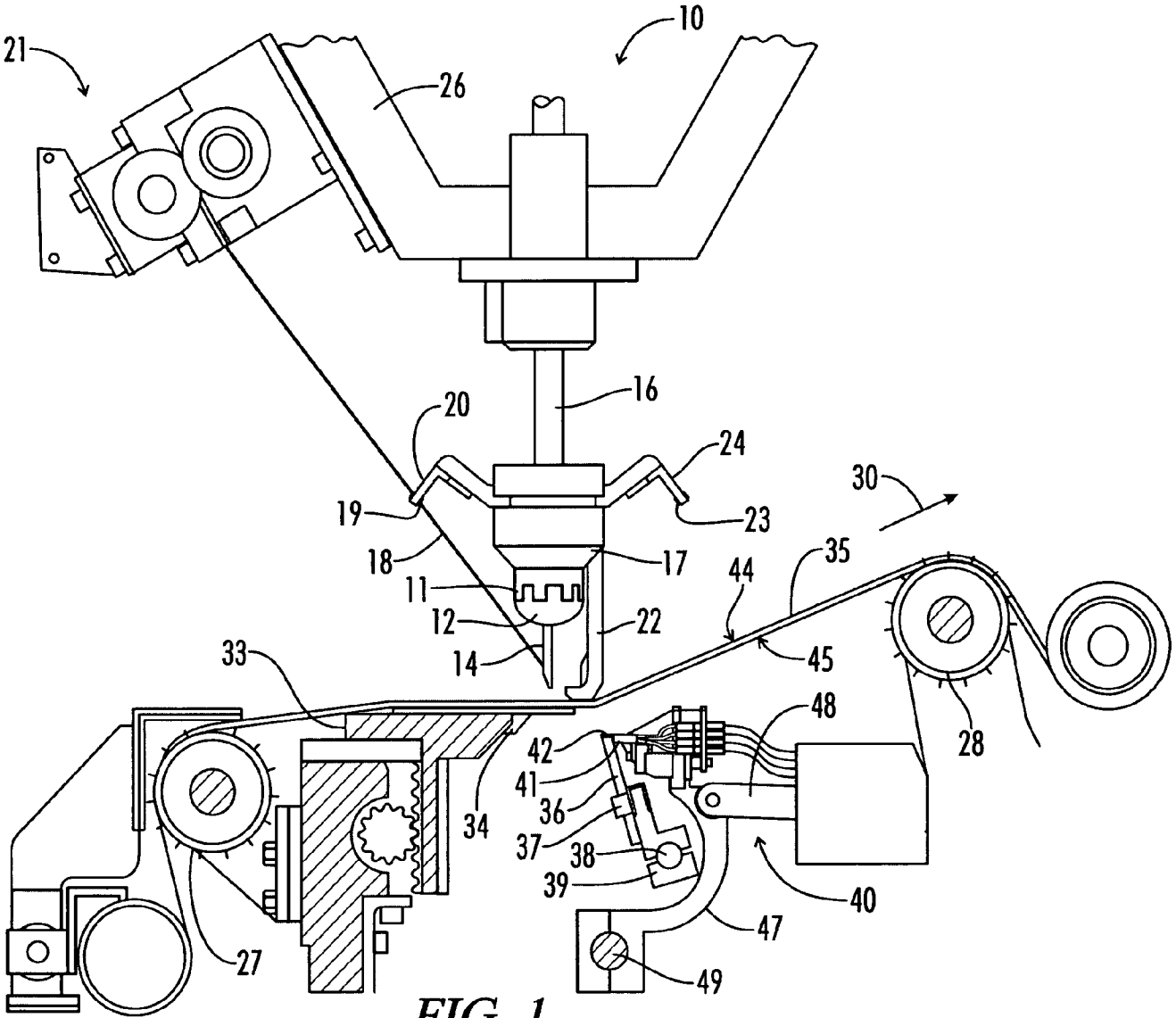
FIG. 1 is a sectional end view of a multiple needle tufting machine constructed for use with a sliding gate assembly of the present invention.

FIG. 1 discloses a tufting machine 10 including transversely supported needle bar 12 which in turns supports a row of transversely spaced needles 14. The needle bar carrier 11 is connected to push rod 16 adapted to be vertically reciprocated by a conventional needle drive mechanism, not shown. Front yarns 18 are supplied to the needles 14 through apertures 19 in the front yarn guide plate 20 from a source of yarn supply, not shown, such as yarn feed rolls, creels, beams or other known yarn supply means. Preferably the front yarns pass through a yarn feed pattern control mechanism 21 adapted to feed the appropriate length of individual yarns 18 to corresponding needles 14 in accordance with a pre-determined pattern. Any one of several pattern control mechanisms may be incorporated in the mechanism 21 such as those disclosed in U.S. Pat. Nos. 6,244,203 and 6,283,053, or earlier mechanisms, and typically the pattern control mechanisms attach to the head 26 of tufting machine 10.

When needed, rear yarns may be correspondingly fed through apertures 23 in rear yarn guide plates 24 from another source or supply of yarns. If desired, the needle bar 12 may be slideably mounted and shifted by appropriate pattern control means in a well known manner, such as by cams, roller drives, or hydraulic shifters.

Supported upon a needle plate 32 and fixed to bed frame 33 are a plurality of straight rearward projecting transversely spaced needle plate fingers 34 extending between the vertical needle paths of the reciprocal needles 14. The substrate or base fabric 35 is supported for longitudinal rearward movement over the needle plate 32. The base fabric is drawn by conventional fabric feed mechanism or substrate drive such as a belt and pulley mechanism or servo motors powering spiked substrate drive rolls 27, 28.

The needle drive mechanism, not shown, is designed to actuate push rod 16 to vertically reciprocate the needle bar 12 and to cause the needles 14 to simultaneously penetrate the substrate 35 far enough to carry the yarns 18 through the substrate 35 to form loops therein. After the loops are formed, the needles 14 are vertically withdrawn to their elevated retracted position disclosed in FIG. 1.

A looper apparatus 40 made in accordance with the invention includes a plurality of transversely spaced hooks 41, there being at least one hook 41 for each needle 14 in the usual case. The hooks 41 are arranged so that the bill 42 of a hook 41 will cross and engage each needle 14 when the needle 14 is in its lowermost position and in a well known manner seize the yarn 18 and form a loop therein. The bills of the hooks 41 point forward opposite the direction of the fabric feed as indicated by the arrow 30. Hooks 41 are mounted in hook bars and secured at the upper end of rocker arm 47. Any conventional means to oscillate the rocker arm 47 may be provided. In a customary embodiment, the lower end of the rocker arm 47 is clamped to laterally extending rock shaft 49. Pivotably connected to the upper portion of the rocker arm 47 is one end of a connecting link 48 having its other end pivotably connected to a jack shaft rocker arm mounted on a jack shaft which has an oscillating motion imparted thereto by a drive means, such as a cam and lever apparatus in communication with the main drive shaft, so that the jack shaft oscillates in timed relationship to the reciprocation of the needles 14. The tufting machine 10 also incorporates a plurality of knives 36 which may cooperate with the hooks to cut selected loops to form cut pile tufts or bights of yarn as hereinafter described. The knives 36 may be mounted in knife blocks 37 and then mounted to a knife shaft rocker arm 39 which is clamped to knife shaft 38. Oscillatory movement is imparted to the knife shaft 38 to conventionally drive the knives into engagement with one side of the respective hooks 41 as known in the art to provide a scissors-like cutting action.

In conventional tufting machine operation, the yarn feed pattern control mechanism 21 is programmed to feed selected yarns 18 at varying lengths in order to produce a desired high-low pattern of tufted bights of yarn. The yarns 18 can be selected from different colors or varying size or physical characteristics. Additional patterning capability may be provided by shifting the needle bar 12 as the substrate 35 moves in the direction of arrow 30 rearwardly through the machine 10. The patterns formed on the substrate 35 appear on the bottom surface 45 while the upper surface 44 of the substrate 35 contains the back stitching necessary to permit needles 14 to move from one tufting location to another. After passing through the tufting zone, the backing fabric 35 is directed under a presser foot 22 and upward away from the tufting zone to provide space for the gated looper apparatus 40 of the present invention.

Figure 2A:
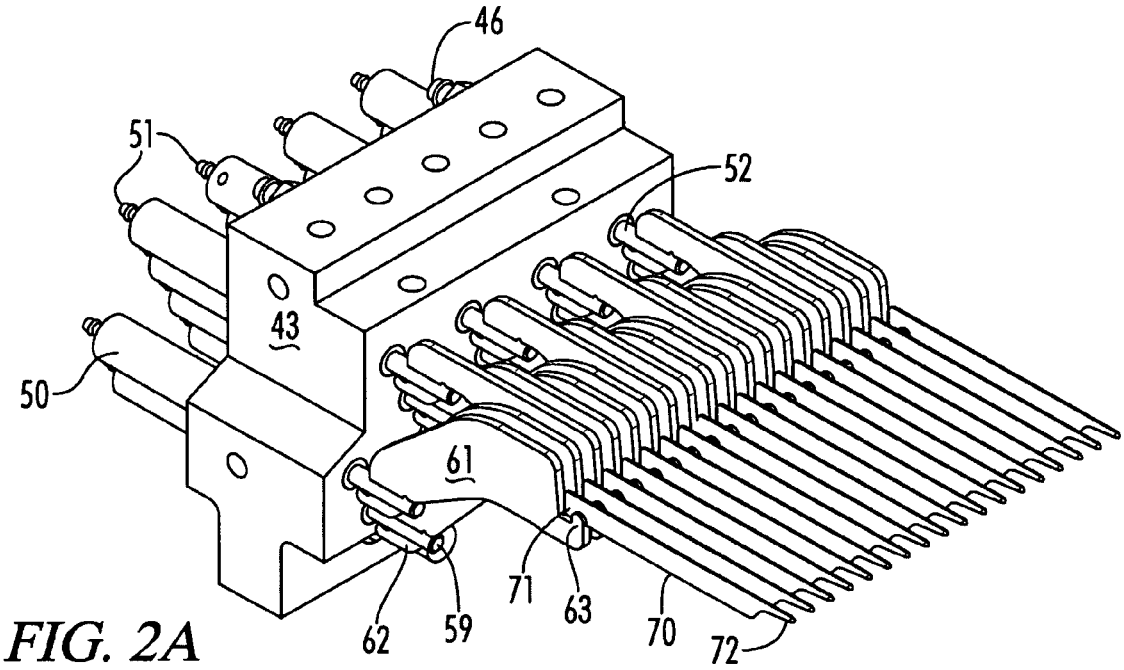
FIG. 2A is a front perspective view of an embodiment of an eighteen double acting pneumatic cylinder array together with corresponding connectors and sliders.

Central to the operation of gated loopers is the use of pneumatic cylinders 50 as shown in FIG. 2A. Cylinder 50 has a rear portion with inlet opening 51 to receive pressurized gas, cylinder wall 53 defining a cylinder in which piston 52 may move reciprocally, and head 55 which stops the forward movement of piston 52 in response to the pneumatic force of the pressurized gas from the inlet 51. A drive rod 54 extends from the piston 52 forward and out through the head 55 of the cylinder 50 to a rod tip 59. Near the rod tip 59 is a slot 60.

Slot 60 is adapted to receive a first end 62 of connector 61. The connectors 61 have first ends 62 interfacing with drive rods 54. The connectors 61 also have a body 64 and a second end 63 that interfaces with rear end 7 of sliders 70. In operation the sliders 70 pass through the hook block so that their front ends 72 are moveable to selectively open or close the lip formed by hook bill 42 of an associated hook 41, all as explained in greater detail in U.S. Pat. No. 7,222,576 which is incorporated herein by reference.

Figure 2B:
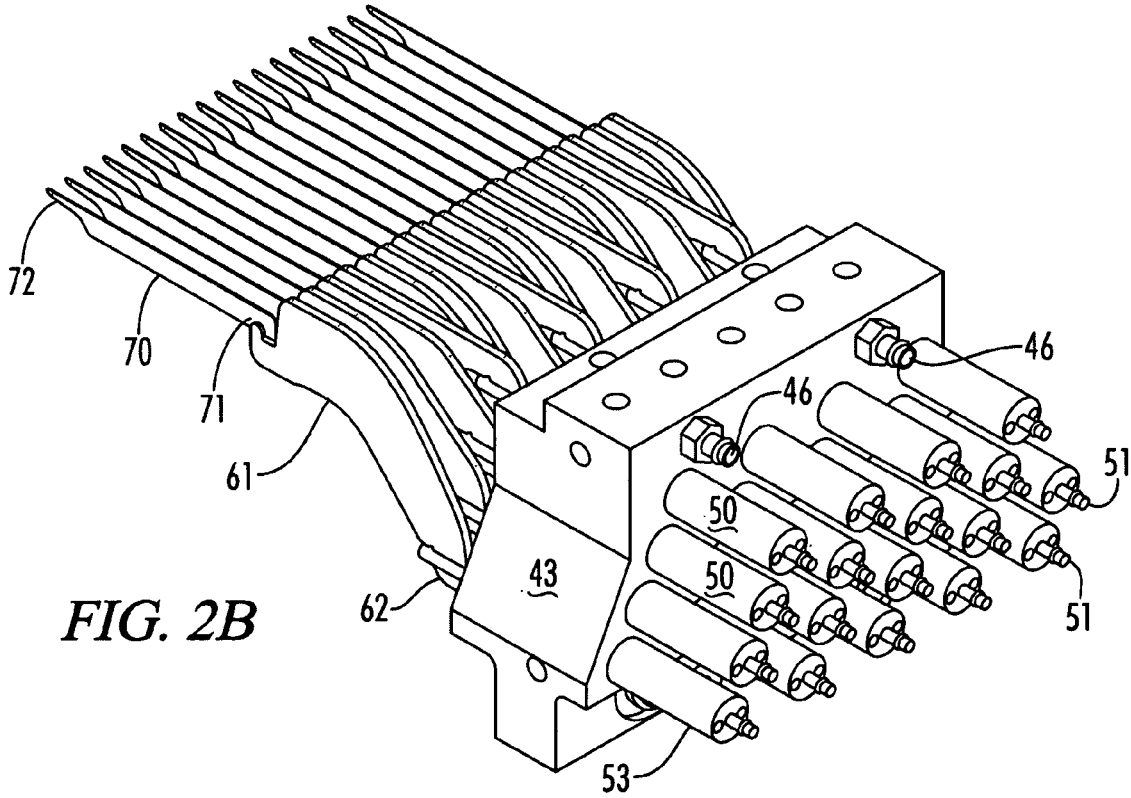
FIG. 2B is a reverse angle perspective view of the pneumatic cylinder array of FIG. 2A.

FIGS. 2A and 2B illustrate a cylinder block 43 holding an array of eighteen pneumatic cylinders 50 each with air pressure inlet openings 51. The cylinder block 43 also has inlets 46 that transmit air pressure through one or more channels interior to the cylinder block 43.

Figure 3A:
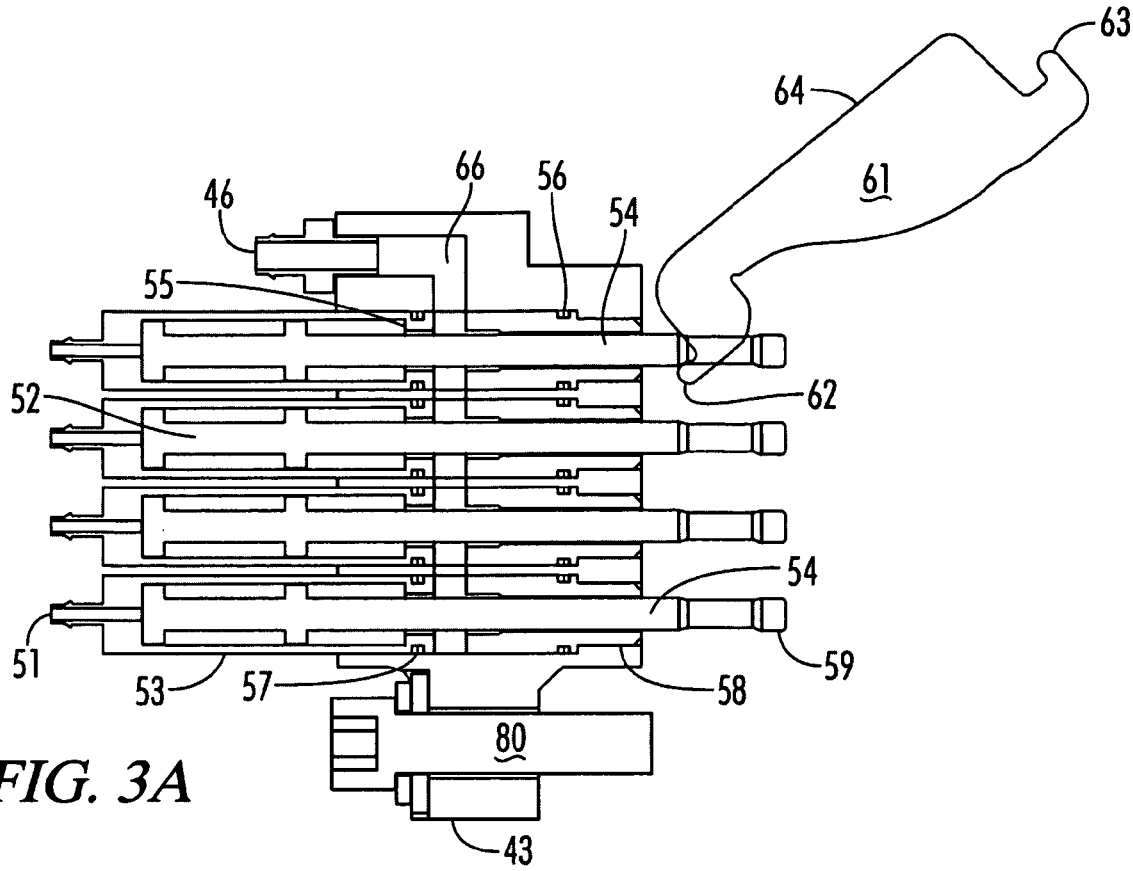
FIG. 3A is a side sectional view showing the introduction of a connector into a forward slot of a piston in an embodiment of an array of double acting pneumatic cylinders.
Figure 3B:
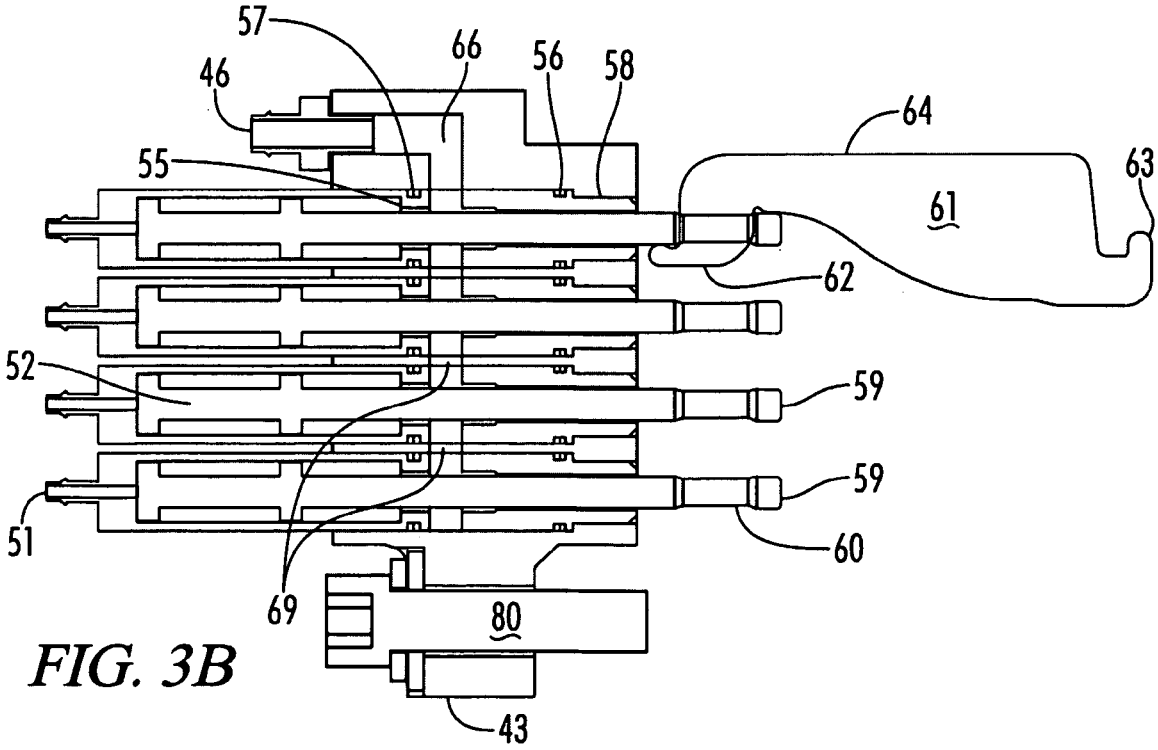
FIG. 3B is a side sectional view illustrating the connector of FIG. 3A in its fully engaged position.

FIGS. 3A and 3B show an exemplary interface between connectors 61 and pistons 52. The pistons 52 are shown in greater detail in FIGS. 4A and 4B. At the rear ends of the pistons is a rear pneumatic surface area 67 and at the opposite forward ends of the pistons is a distal tip 59. Near the distal tip 59 is a slot 60 which is adapted to receive the first tabbed end 62 of connector 61 as shown in FIGS. 3A and 3B. These figures also show mounting bolt 80 that is used to position the cylinder block in proximity to the hook block. In addition, it can be seen that the pressurized air inlets 46 in the cylinder block 43 lead to a channel 66 that connects to each of the pneumatic cylinders 50 mounted in the cylinder block 43. The cylinders 50 are also fitted with a front seal 56 and a rear seal 57 on either side of the pneumatic channel 66 so that pressure applied through inlet 46 is directed through openings 69 in the walls 53 of cylinders 50 to act upon the piston 52 contained therein. Within the pneumatic cylinders 50, the forward motion of piston 52 is constrained by the front pneumatic surface 68 contacting piston head 55. The forward most part 58 of pneumatic cylinders 50 is preferably threaded in order to securely mount the cylinder 50 within the cylinder block 43. Individually threaded pneumatic cylinders 50 allow for greater ease in manufacture and repairing cylinder arrays, however, cylinders may be held in position in other fashions as by a rear mounting plate that connects to the back of the cylinder block 43.

Figure 4A:
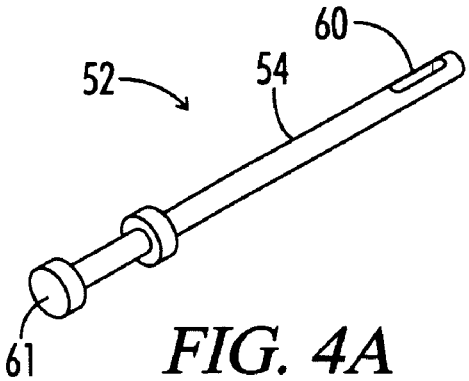
FIG. 4A is a rear perspective view of a piston adapted for use in a double acting cylinder.
Figure 4B:
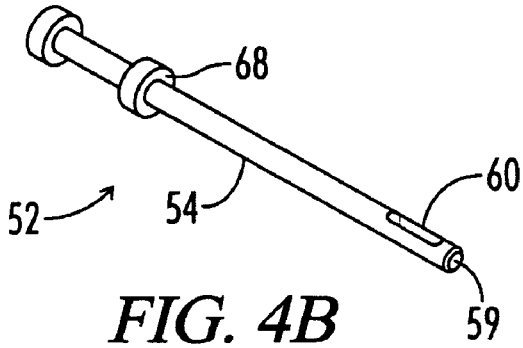
FIG. 4B is a reverse angle view of the piston of FIG. 4A.

FIGS. 4A and 4B show an exemplary piston 52 in isolation. It can be seen that the rear pneumatic surface 67 has a greater surface area than the front pneumatic surface 68. Because the force exerted upon the piston is the product of the air pressure and the area of the piston surface to which that air pressure is applied, if equal pressure is applied to cylinder inlets 51 and to cylinder block inlets 46, the greater area of the rear pneumatic surface 67 will cause the piston 52 to move forward as is illustrated in the case of piston 52*a* of FIG. 5B.

Figure 5A:
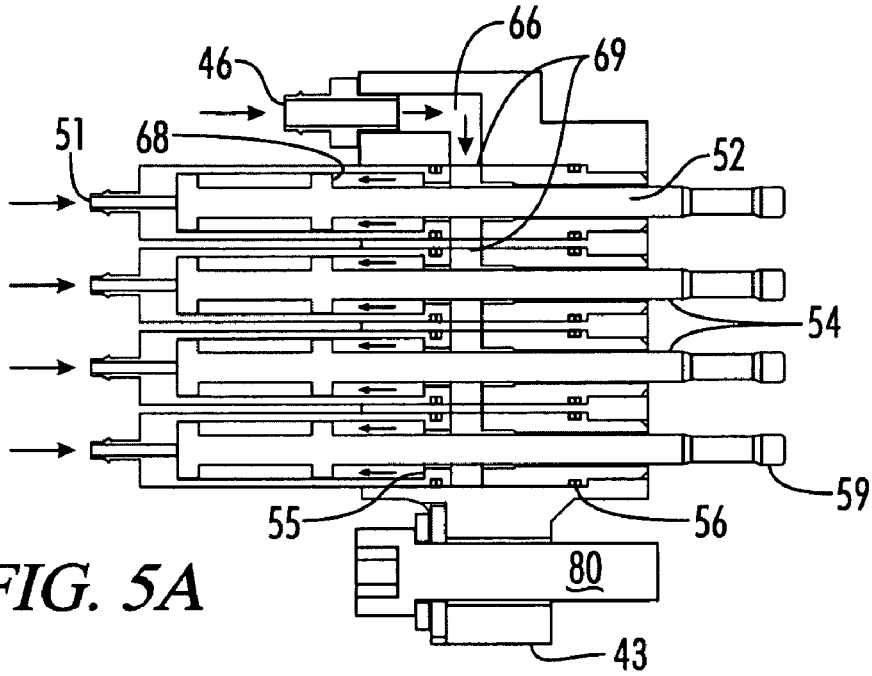
FIG. 5A is a side sectional view of an array of double acting pistons according to an embodiment of the invention with all of the pistons in retracted positions.
Figure 5B:
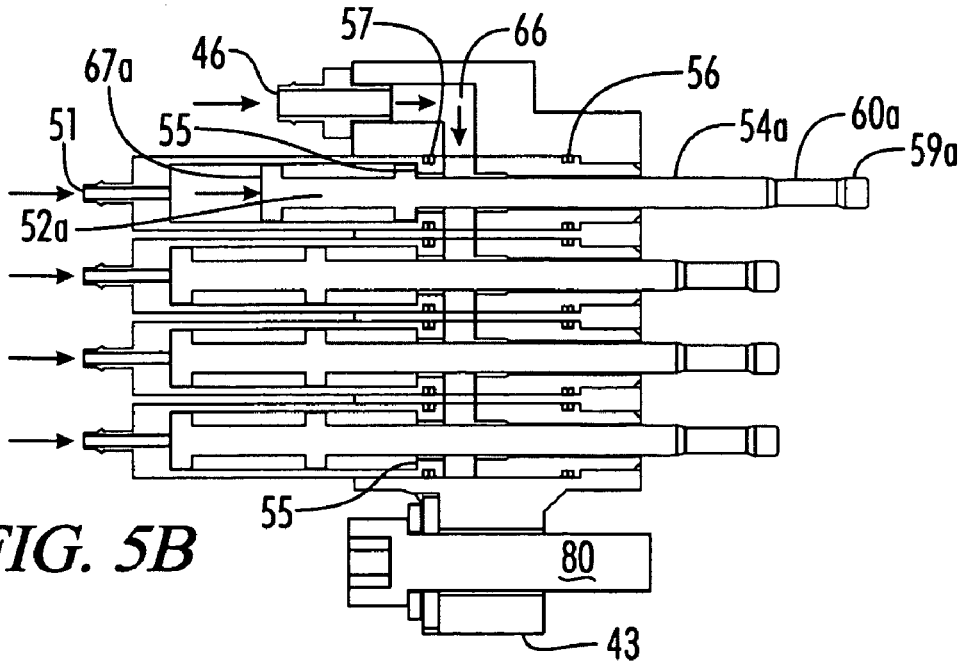
FIG. 5B illustrates the pneumatic cylinder assembly of FIG. 5A with the top most piston in its extended position.

In operation, it is preferred that a constant low pressure be introduced into the cylinder blocks 43 through inlets 46 which tends to move all of the pistons 52 and their associated drive rods 54, slots 60, and tips 59 to a rear position that retracts the corresponding slider 70 and leaves the lip of the associated hook open. It can be seen in FIG. 5A that air pressure introduced through inlet 46 communicates through passage 66 and openings 69 in the cylinder walls 53 to act upon front pneumatic surfaces 68 and move the rear pneumatic surface 67 completely to the back of pneumatic cylinders 50. In FIG. 5B the constant low pressure continues to be introduced through inlet 46, however, an equal or preferably greater pressure is introduced through inlet 51*a* to act upon the rear pneumatic surface 67*a* of piston 52*a*. This moves the associated drive rod 54*a* of piston 52*a* forward together with slot 60*a* holding a connector 61 with second end 63 communicating with a rear end 71 of slider 70 to thereby close front end 72 as a looper gate over the lip of an associated hook.

Generally, the high pressure applied to the inlets 51 of pneumatic cylinders 50 will be about sixty pounds per square inch and the lower pneumatic pressure applied through inlets 46 of cylinder blocks 43 will be about thirty pounds per square inch. However, these pressures are not critical and lower pressures of about 40-20 lbs per square inch and higher pressures of about 100-50 lbs per square inch produce suitable results. Higher pressures produce a faster response time for the pistons 52 and their associated looper gates but also impose greater stress on components of the system.

It will be seen that in a double acting cylinder system according to the invention, only the high pressure gas applied to inlets 51 of pneumatic cylinders 50 need be controlled on a cylinder by cylinder basis. The low pressure applied to cylinder blocks 43 remains constant so there is constant force urging the pistons to move their associated sliders back into the rear piston position that leaves the associated hooks uncovered. Thus, it is only necessary to communicate pattern information to controllers that supply high pressure gas to the pneumatic cylinders 50 and the low pressure tending to return the pistons 52 to their retracted position is constant.

Each of the foregoing patents, patent applications and publications mentioned herein is incorporated in its entirety in this disclosure by reference. Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A gated looper apparatus for use in a tufting machine comprising an array of pneumatic cylinders individually mounted to cylinder block, each pneumatic cylinder having a piston responsive to pressure applied to a first inlet to the pneumatic cylinder to cause an associated slider to move forward, thereby moving an associated gate forward and covering the hook bill of an associated hook and responsive to pressure applied to a second inlet to the pneumatic cylinder to cause the associated slider to move rearward.

2. The gated looper apparatus of claim 1 wherein pressure is applied to the second inlets of the array of pneumatic cylinders through channels in the cylinder block.

3. The gated looper apparatus of claim 1 wherein the piston has a rear surface on which pressure from the first inlet acts and a front surface on which pressure from the second inlet acts, configured such that the rear surface has a greater area than the area of the front surface.

4. The gated looper apparatus of claim 1 wherein the piston has a piston rod extending forward and out of the cylinder, said piston rod having a slot at the distal end to receive a tabbed end of a connector.

5. The gated looper apparatus of claim 4 wherein an opposite end of the connector communicates with the slider to move the associated gate.

6. The gated looper apparatus of claim 1 wherein a constant pneumatic pressure is applied to all of the second inlets of the array of pneumatic cylinders and pneumatic pressure is individually applied to first inlets of the array in accordance with pattern information.

7. The gated looper apparatus of claim 6 wherein the constant pneumatic pressure applied to all of the second inlets is between 20 and 40 pounds per square inch.

8. The gated looper apparatus of claim 6 wherein the pneumatic pressure applied to first inlets is between 50 and 100 pounds per square inch.

9. The gated looper apparatus of claim 3 wherein a constant pneumatic pressure is applied to all of the second inlets of the array of pneumatic cylinders and pneumatic pressure is individually applied to first inlets of the array in accordance with pattern information.

10. The gated looper apparatus of claim 2 wherein a constant pneumatic pressure is applied to all of the second inlets of the array of pneumatic cylinders and pneumatic pressure is individually applied to first inlets of the array in accordance with pattern information.

11. A cylinder array for a tufting machine having a plurality of hooks having hook bills and associated slideable gates to open or close lips formed by said hook bills comprising:

a cylinder block in which a plurality of cylinders are mounted, each of said cylinders having a first inlet, a second inlet, and a piston with a piston rod extending from the cylinder;

a first air supply connected to the first inlets wherein the pneumatic pressure supplied to each cylinder is individually controlled in accordance with pattern information;

a second air supply providing relatively uniform pneumatic pressure to the second inlets.

12. The cylinder array of claim 11 wherein pressure is applied to the second inlets of the array of pneumatic cylinders through channels in the cylinder block.

13. The cylinder array of claim 11 wherein the piston has a rear surface on which pressure from the first inlet acts and a front surface on which pressure from the second inlet acts, configured such that the rear surface has a greater area than the area of the front surface.

14. The cylinder array of claim 11 wherein the constant pneumatic pressure applied to the second inlets is between 20 and 40 pounds per square inch.

15. The cylinder array of claim 11 wherein the individually controlled pneumatic pressure applied to first inlets is between 50 and 100 pounds per square inch.

16. The cylinder array of claim 11 wherein the piston rod has a slot at its distal end to receive a tabbed end of a connector.

17. The cylinder array of claim 11 wherein an opposite end of the connector communicates movement to an associated gate to cover or uncover a hook bill of an associated hook

18. A gated looper apparatus for use in a tufting machine comprising:

(a) a first air supply;

(b) a second air supply;

(c) a cylinder mounting block having inlets to communicate pneumatic pressure throughout channels in the block;

(d) a plurality of cylinders having a first inlet, a second inlet, and a piston with a piston rod extending from the cylinder, being mounted in the cylinder mounting block;

wherein the first air supply is connected to the first inlets of the cylinders and the second air supply is connected to the second inlets of the cylinders via the inlets and channels of the cylinder mounting block.

19. The gated looper apparatus of claim 18 wherein the second air supply provides relatively uniform pneumatic pressure to the second inlets.

20. The gated looper apparatus of claim 18 wherein the pneumatic pressure supplied to each cylinder by the first air supply through the first inlets is individually controlled in accordance with pattern information.

* * * * *